US009284109B2

(12) United States Patent
James et al.

(10) Patent No.: US 9,284,109 B2
(45) Date of Patent: Mar. 15, 2016

(54) DISPENSER FOR FLEXIBLE SHEETS

(71) Applicant: Dow Global Technologies LLC, Midland, MI (US)

(72) Inventors: Timothy James, Brooklyn, NY (US); Haley A. Lowry, Houston, TX (US); Jill M. Martin, Brazoria, TX (US)

(73) Assignee: Dow Global Technologies LLC, Midland, MI (US)

( * ) Notice: Subject to any disclaimer, the term of this patent is extended or adjusted under 35 U.S.C. 154(b) by 199 days.

(21) Appl. No.: 13/971,427

(22) Filed: Aug. 20, 2013

(65) Prior Publication Data

US 2014/0231289 A1 Aug. 21, 2014

Related U.S. Application Data

(63) Continuation-in-part of application No. 29/446,114, filed on Feb. 20, 2013, now Pat. No. Des. 727,054.

(51) Int. Cl.

| | |
|---|---|
| ***B65D 83/00*** | (2006.01) |
| ***B65D 75/56*** | (2006.01) |
| ***B65D 75/58*** | (2006.01) |
| ***B65D 83/08*** | (2006.01) |

(52) U.S. Cl.

CPC ..... *B65D 83/00* (2013.01); *B65D 75/566* (2013.01); *B65D 75/5827* (2013.01); *B65D 83/0805* (2013.01); *B65D 2575/565* (2013.01)

(58) Field of Classification Search

CPC ..... B65D 85/04; B65D 85/672; B65D 75/58; B65D 75/5805; B65D 33/2533; B65D 75/5811; B65D 75/5833

USPC ..... 206/389, 391, 397, 409, 494; 383/200, 383/201, 203, 204, 207, 209, 107, 120; 221/155, 63

See application file for complete search history.

(56) References Cited

U.S. PATENT DOCUMENTS

| | | | | |
|---|---|---|---|---|
| 4,444,827 | A * | 4/1984 | Swaroop | 428/216 |
| 4,852,732 | A * | 8/1989 | Wilski et al. | 206/204 |
| D341,046 | S | 11/1993 | Clark, Jr. | |
| D374,360 | S | 10/1996 | Angermeir | |
| 5,671,847 | A | 9/1997 | Pedersen et al. | |
| 6,283,405 | B1 | 9/2001 | Tracy | |
| 7,040,567 | B1 | 5/2006 | Lewis et al. | |

(Continued)

FOREIGN PATENT DOCUMENTS

FR 2977873 A1 1/2013

OTHER PUBLICATIONS

Machine translation of FR2977873.

*Primary Examiner* — Chun Cheung

(74) *Attorney, Agent, or Firm* — Whyte Hirschboeck Dudek S.C.

(57) ABSTRACT

The present disclosure provides a dispenser for dispensing flexible sheets. The dispenser includes (A) a pouch composed of at least one flexible multilayer film. The pouch includes (i) a front wall joined to a rear wall along a top seal and a bottom seal and (ii) a first sidewall and an opposing second sidewall. Each sidewall is joined to the front wall and the rear wall with a respective first side seal and a second side seal. The pouch also includes (iii) a flap above the pouch that is joined to the pouch along the top seal. The dispenser also includes (B) a roll of continuous flexible sheets in an interior of the pouch. The dispenser further includes (C) a slot along the front wall through which the flexible sheets are removed from the pouch.

15 Claims, 3 Drawing Sheets

(56) References Cited

U.S. PATENT DOCUMENTS

| | | | | |
|---|---|---|---|---|
| D524,084 | S | 7/2006 | Wieser et al. | |
| D651,831 | S | 1/2012 | Becherer et al. | |
| D666,854 | S | 9/2012 | Valadao | |
| 8,622,619 | B2 * | 1/2014 | Adams et al. | 383/207 |
| D704,951 | S | 5/2014 | Coleman | |
| 8,944,684 | B2 * | 2/2015 | Bell | 383/5 |
| 2006/0204148 | A1 | 9/2006 | Kohn | |
| 2007/0151887 | A1 * | 7/2007 | Clark et al. | 206/494 |
| 2008/0173662 | A1 | 7/2008 | Che | |
| 2008/0187256 | A1 * | 8/2008 | Hishinuma | 383/94 |
| 2009/0214142 | A1 | 8/2009 | Bossel et al. | |

* cited by examiner

DISPENSER FOR FLEXIBLE SHEETS

PRIORITY

This application claims priority to U.S. Design patent application Ser. No. 29/446,114 filed on 20 Feb. 2013, the entire content of which is incorporated by reference herein.

BACKGROUND

The present disclosure is directed to a dispenser for dispensing flexible sheets.

Current trends in consumer purchasing behavior emphasize convenience, compactness, and product shelf appeal. A common consumer product is a trash can liner. Trash can liners are typically sold as a roll of continuous flexible sheets located inside a rectangular-shaped package. Conventional trash can liner packages are bulky and burdensome to handle for consumers. The unwieldiness of these bulky packages is apparent to the consumer when attempting to bag these packages during checkout. Handling, transporting, and loading such conventional bulky packages is cumbersome and awkward—especially when the consumer's purchase includes additional household goods and/or groceries. Moreover, conventional rectangular-shaped trash can liner packages lack product differentiation.

A need therefore exists for a flexible sheet dispenser that is compact, portable and convenient to use. A further need exists for a trash can liner dispenser that provides product differentiation and enhanced shelf appeal.

SUMMARY

The present disclosure provides a dispenser for dispensing flexible sheets. In an embodiment, the dispenser includes (A) a pouch composed of at least one flexible multilayer film. The pouch includes (i) a front wall joined to a rear wall along a top seal and a bottom seal and (ii) a first sidewall and an opposing second sidewall. Each sidewall is joined to the front wall and the rear wall with a respective first side seal and a second side seal. The pouch also includes (iii) a flap above the pouch and joined to the pouch along the top seal. The dispenser includes (B) a roll of continuous flexible sheets in an interior of the pouch. The dispenser further includes (C) a slot along the front wall through which the flexible sheets are removed from the pouch.

DETAILED DESCRIPTION

Figure 1:
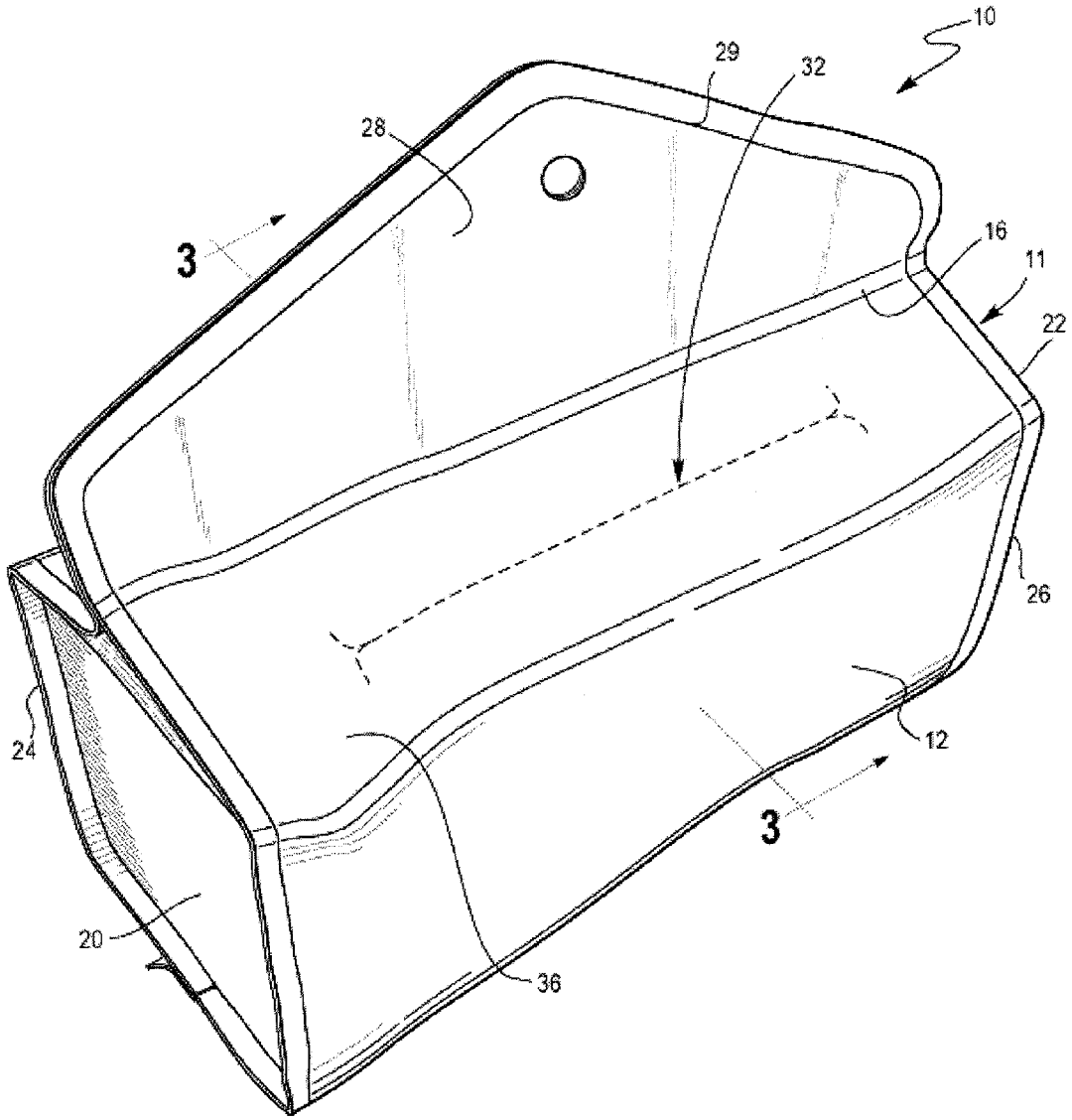
FIG. 1 is a perspective view of a dispenser in accordance with the present disclosure.

The present disclosure provides a dispenser for dispensing flexible sheets. The dispenser includes a pouch composed of at least one flexible multilayer film. The pouch includes (i) a front wall joined to a rear wall along a top seal and a bottom seal. The pouch also includes (ii) a first sidewall and an opposing second sidewall. Each sidewall is joined to the front wall and the rear wall with a respective first side seal and a second side seal. A flap is located above the pouch. The flap is joined to the pouch along the top seal. The dispenser also includes a roll of continuous flexible sheets located in an interior of the pouch. The dispenser further includes a slot located along the front wall. The sheets are removed from the pouch through the slot.

A. Pouch

The dispenser includes a pouch. The pouch is composed of, or is otherwise formed from, at least one flexible multilayer film. The multilayer film is resilient, flexible, deformable, and pliable. Accordingly, so too is the pouch resilient, flexible, deformable, and pliable.

The pouch can be made from a single flexible multilayer film (a film folded over upon itself and sealed). Alternatively, the pouch can be made from opposing webs that are formed and sealed, the opposing webs composed of the flexible multilayer film.

The flexible multilayer film is made from one or more polymeric materials. Nonlimiting examples of suitable polymeric materials include olefin-based polymer, propylene-based polymer (including plastomer and elastomer, random copolymer polypropylene, homopolymer polypropylene, and propylene impact copolymer) and ethylene-based polymer (including plastomer and elastomer, high density polyethylene ("HDPE"), low density polyethylene ("LDPE"), linear low density polyethylene ("LLDPE"), and medium density polyethylene ("MDPE"), olefin block copolymer, polyethylene terephthalate ("PET"), oriented polyethylene terephthalate ("OPET"), nylon, biaxially oriented polypropylene (BOPP), ethylene vinyl alcohol (EVOH), functionalized ethylene-based polymers such as ethylene-vinyl acetate ("EVA"), maleic anhydride-grafted polyethylene, and ethylene acrylate copolymers, fluorinated ethylene propylene, blends thereof, and multilayer combinations thereof.

The flexible multilayer film has an innermost seal layer, an outer print layer and one or more optional intermediate layers sandwiched between the innermost layer and the print layer. The intermediate layers may include barrier layers, structural layers, adhesive layers, and combinations thereof. The multilayer film may be produced by way of coextrusion, lamination, and combinations thereof.

In an embodiment, the pouch is made from two opposing webs, each web composed of the flexible multilayer film. The composition of each web may be the same or different. In a further embodiment, the pouch is made from two webs, each web composed of a flexible multilayer film having the same structure and the same composition.

In an embodiment, the flexible multilayer film has an innermost layer that is a seal layer, an outer print layer, and optional intermediate layers sandwiched between the seal layer and the print layer.

In an embodiment, printing is applied to the webs during construction of the pouch, thereby forming a flexible multilayer film having a print layer. The printing includes advertisement, branding, instructions for use, instructions for recycle, and any combination thereof. The print web is subsequently laminated to a sealant web by applying an adhesive layer to the print web and/or the sealant web.

The print web may be direct-printed and covered with a layer of protective varnish. Alternatively, the print web may be reverse-printed and laminated to a sealant web by applying an adhesive layer to the print web and/or the sealant web. Any web may contain a filler to provide additional stiffness, or opacity, or both stiffness and opacity.

In an embodiment, the print layer is a polymeric material selected from biaxially or uniaxially oriented polypropylene (BOPP, OPP), PET, bi-axially oriented PET (BOPET), and combinations thereof.

In an embodiment, the seal layer is a polymeric material selected from LLDPE, single-site LLDPE (substantially linear olefin polymers, including polymers sold under the tradename AFFINITY (The Dow Chemical Company) for example), or propylene-based plastomers or elastomers and their blends, ethylene-vinyl acetate, and blends with polyisobutylene (PIB), or ionomers (AMPLIFY).

In an embodiment, the seal layer is an ethylene-based polymer such as LLDPE and the print layer is a PET. The PET allows for printing to be easily placed directly on the flexible multilayer film because it does not stretch during the printing process. The LLDPE seal layer allows for the formation of heat seals during formation of the pouch.

In an embodiment, the flexible multilayer film exhibits suitable tear, toughness, and seal performance (i) to withstand a form, fill, and seal production process, and (ii) to meet industrial and household applications of the dispenser.

The flexible multilayer film has a thickness from 2 mils, or 4 mils, or 6 mils to 8 mils, or 10 mils, or 12 mils. In an embodiment, the flexible multilayer film has a thickness from 2 mils, or 4 mils, or 4.5 mils, to 5 mils, or 6 mils.

In an embodiment, the flexible multilayer film is a 4.5 mil laminate with the following structure: ethylene-octene copolymer/LLDPE/tie/PET and having one, some, or all of the following properties:

a secant modulus from 40,000 psi, or 60,000 psi, or 100,000 psi, or 200,000 psi to 300,000 psi, or 400,000 psi, or 500,000 psi, or 600,000 psi as measured in accordance with ASTM D 882;

a dart impact strength from 20 g to 400 g as measured in accordance with ASTM D 1709;

a tear strength (cross direction) from 500 g to 700 g as measured in accordance with ASTM D 624; and a tear strength (machine direction) from 200 g to 700 g as measured in accordance with ASTM D 624.

i. Pouch Walls

The pouch includes a front wall joined to a rear wall. The front wall and the rear wall are joined along a top seal and a bottom seal. The top seal and the bottom seal each extend longitudinally along the entire length, or along substantially the entire length, of the pouch.

The pouch has a bottom surface which includes a lower portion of the front wall and a lower portion of the rear wall. The front wall lower portion and the rear wall lower portion are proximate to, or are otherwise adjacent to, the bottom seal. The bottom surface of the pouch contacts a horizontal surface, or a substantially horizontal surface, and holds or otherwise maintains the dispenser in an upright position, or in a substantially upright position.

The pouch includes a first sidewall and a second sidewall. The first sidewall is located at a first end of the pouch. The second sidewall opposes the first sidewall, the second sidewall located at a second end of the pouch.

A first side seal joins the first sidewall to the front wall and to the rear wall. A second side seal joins the second sidewall to an opposing end of the front wall and the rear wall. The front wall, the rear wall, and the sidewalls form a closed interior of the pouch.

In an embodiment, each side seal is a perimeter seal. Each perimeter seal extends around and along the entire perimeter, or around and along substantially the entire perimeter, of each respective sidewall. Each perimeter seal defines an interface between each respective sidewall and the front wall/rear wall. In this way, each sidewall and respective perimeter seal form a gusset panel.

ii. Flap

A flap is located above the pouch. The flap is joined to the pouch along the top seal. The flap is made from the same flexible multilayer film as the walls (front wall, rear wall, and sidewalls). When the pouch is made by way of opposing webs, the flap is integral to the walls. The top seal is a three-way interface between the front wall, the rear wall, and the flap.

In an embodiment, the flap includes a peripheral seal that extends from one end of the top seal, along and around the periphery of the flap, and to a second end of the top seal.

In an embodiment, the flap includes a hole. The hole is configured to hang or otherwise suspend the dispenser from a support structure. Nonlimiting examples of suitable support structures for hanging the dispenser include a hook, a door knob, and a cabinet handle.

In an embodiment, the hole can be configured to be a handle for carrying the dispenser. In a further embodiment, the hole is configured as a carrying handle that is also suitable for hanging the dispenser during use.

Each seal (top seal, bottom seal, perimeter seal, and peripheral seal) of the pouch can be a heat seal, an ultrasonic seal, or a radio frequency (Rf) seal, an adhesive seal, and combinations thereof. In an embodiment, each seal of the pouch is a heat seal.

In an embodiment, the top seal is a heat seal and has a seal strength from 20 Newtons (N)/25.4 mm to 60 N/25.4 mm as measured in accordance with ASTM F 88.

In an embodiment, the bottom seal is a fold seal that is a heat seal and has a seal strength from 20 N/25.4 mm to 60 N/25.4 mm as measured in accordance with ASTM F 88.

In an embodiment, the top seal is a heat seal and has a seal strength from 20 N/25.4 mm to 60 N/25.4 mm as measured in accordance with ASTM F 88.

In an embodiment, the first side seal and the second side seal each is a heat seal and has a seal strength from 20 N/25.4 mm to 60 N/25.4 mm as measured in accordance with ASTM F 88.

In an embodiment, the peripheral seal is a heat seal and has a seal strength from 20 N/25.4 mm to 60 N/25.4 mm as measured in accordance with ASTM F 88.

B. Roll

The dispenser includes a roll of continuous flexible sheets located in the interior of the pouch. The roll is a series of individual flexible sheets connected to each other in a sequential manner. The individual flexible sheets are connected to each other by way of perforation, interleaving, overlap, and any combination thereof. Nonlimiting examples of suitable flexible sheet include polymer film, metal foil, liners, trash can liners, tissue, paper, paper towel, wipes (wet or dry), and paper. Other suitable sheets include floor cleaning sheets and fabric softener sheets. In an embodiment, each individual flexible sheet is a single use material.

In an embodiment, the roll is a continuous roll of trash can liners. In a further embodiment, the roll is a continuous roll of trash can liners sequentially arranged in an overlap manner.

The roll has an axis of rotation that is parallel to, or substantially parallel to, the following structure: (i) the top seal, (ii) the bottom seal, (iii) the longitudinal axis of the pouch, and (iv) any combination of (i), (ii) and (iii).

In an embodiment, the roll is coreless.

A headspace is present in the pouch. The "headspace," as used herein, is defined as the interior volume of the pouch above a plane containing the uppermost surface of roll (before the roll diameter is reduced by removal of a flexible sheet). The headspace is from 1%, or 3%, or 5%, or 7% to 9%, or 11%, or 13% or 15% the interior volume of the entire pouch.

C. Slot

The present dispenser includes a slot. The slot is located on the front wall. In an embodiment, the slot is located on an upper portion of the front wall. The slot provides an opening through which the flexible sheets are removed from the dispenser.

The slot has a length that is: (i) less than the width of the roll, (ii) the same as the width of the roll, or (iii) greater than the width of the roll.

In an embodiment, the slot is a perforated slot.

The slot is parallel to, or substantially parallel to, the following structure: (i) the top seal, (ii) the bottom seal, (iii) the longitudinal axis of the pouch, and (iv) any combination of (i), (ii), and (iii). When a first flexible sheet is pulled through the slot and removed from the dispenser, the pulling motion forces the roll to rotate around the roll's axis of rotation and advance another flexible sheet through the slot.

The slot has a length that is from 20%, or 30%, or 40% to 50%, or 60%, or 70%, or 80% the length of the dispenser.

The front wall has a dispensing geometry that prevents the slot from tearing. The dispensing geometry includes a front wall that is made from a flexible multilayer film with (i) a tear strength from 500 g to 700 g (cross direction), (ii) a tear strength from and 200 g to 700 g (machine direction) as measured in accordance with ASTM 624, or (iii) both (i) and (ii). In addition, the slot includes arcuate edges to reduce, or prevent, the risk of tear at the slot.

D. Dispenser

The dispenser may be formed and filled by way of a horizontal form, fill, and seal procedure. The first sidewall and the second sidewall form respective first and second gusset panels as previously discussed. The gusset panels shape the pouch such that the front wall and the rear wall each have a respective taper portion that extends to the top seal.

In an embodiment, the slot is located on the taper portion of the front wall. The gusset panels advantageously tailor the shape of the pouch to the roll. This taper feature of the front wall and rear wall contributes to producing a pouch having a tailored "form-fit" to the roll. The tailored form-fit of the pouch contributes to the compactness of the dispenser and advantageously reduces the amount of polymeric material required to produce the pouch.

In an embodiment, the dispenser (not including the roll) is made from 90 wt % to 100 wt % ethylene-based polymer. Weight percent is based on total weight of the dispenser not including the roll. The dispenser made from 90 wt % to 100 wt % ethylene-based polymer is advantageous as it is readily recyclable.

In an embodiment, the dispenser is a stand alone dispenser. A "stand alone dispenser," is a dispenser that can stand up by itself, particularly when opened.

The opposing side gusset panels (1) contribute to reducing or eliminating headspace within the pouch interior (which reduces or eliminates bulkiness); (2) contribute to shaping the pouch to the roll which reduces the amount of material (and reduces the pouch's weight) needed to produce the dispenser; (3) shape the pouch to the roll, giving the pouch a cylindrical, or substantially cylindrical shape providing the dispenser with product differentiation (shelf appeal) that promotes consumer appeal; and (4) holds the roll in place, which contributes to easy dispensing of the flexible sheets.

No internal structure is necessary to dispense the flexible sheets from the dispenser.

Further advantages of the present dispenser over (i) cardboard packages and (ii) conventional plastic packages are provided in Table 1 (right column) below.

TABLE 1

| | Advantages of Present Dispenser Compared to: |
|---|---|
| Conventional cardboard packages of flexible sheets | Improved Handle area, Easy to grab the flap & go<br>Can be hung (retail or consumer)<br>Dispenser has 47% less post consumer waste than cardboard packages (based on grams/count)*<br>More efficient packaging (reduced headspace)*<br>Improved appearance and shelf appeal*<br>Better packing in trucks reduces shipping costs<br>Reduced weight (without roll)-present dispenser weight is 20 g compared to 75 g for conventional cardboard package*<br>Dispenser has 73% less material weight than cardboard package (based on grams/count)*<br>No hot melt adhesive cost or storage<br>Cost less for package and for distribution |
| Conventional Plastic dispensers for flexible sheets | Improved billboard<br>Holds heavier counts<br>Improved dispensing geometry (reduced tear)<br>Improved containment after package is opened |

*Comparison based on cardboard package for GLAD tall kitchen drawstring bags - 45 bags (13 gallon) and present dispenser with GLAD tall kitchen drawstring bags - 40 bags (13 gallon)

DEFINITIONS

The numerical figures and ranges here are approximate, and thus may include values outside of the range unless otherwise indicated. Numerical ranges (e.g., as "X to Y", or "X or more" or "Y or less") include all values from and including the lower and the upper values, in increments of one unit, provided that there is a separation of at least two units between any lower value and any higher value. As an example, if a compositional, physical or other property, such as, for example, temperature, is from 100 to 1,000, then all individual values, such as 100, 101, 102, etc., and sub ranges, such as 100 to 144, 155 to 170, 197 to 200, etc., are expressly enumerated. For ranges containing values which are less than one or containing fractional numbers greater than one (e.g., 1.1, 1.5, etc.), one unit is considered to be 0.0001, 0.001, 0.01 or 0.1, as appropriate. For ranges containing single digit numbers less than ten (e.g., 1 to 5), one unit is typically considered to be 0.1. For ranges containing explicit values (e.g., 1 or 2, or 3 to 5, or 6, or 7) any subrange between any two explicit values is included (e.g., 1 to 2; 2 to 6; 5 to 7; 3 to 7; 5 to 6; etc.).

An "ethylene-based polymer," as used herein is a polymer that contains more than 50 mole percent polymerized ethylene monomer (based on the total amount of polymerizable monomers) and, optionally, may contain at least one comonomer.

An "olefin-based polymer," as used herein is a polymer that contains more than 50 mole percent polymerized olefin monomer (based on total amount of polymerizable monomers), and optionally, may contain at least one comonomer. Nonlimiting examples of olefin-based polymer include ethylene-based polymer and propylene-based polymer.

"Polymer" means a compound prepared by polymerizing monomers, whether of the same or a different type, that in polymerized form provide the multiple and/or repeating "units" or "mer units" that make up a polymer. The generic term polymer thus embraces the term homopolymer, usually employed to refer to polymers prepared from only one type of monomer, and the term interpolymer, usually employed to refer to polymers prepared from at least two types of monomers. It also embraces all forms of interpolymers, e.g., random, block, etc. The terms "ethylene/α-olefin polymer" and "propylene/α-olefin polymer" are indicative of interpolymers as described above prepared from polymerizing ethylene or propylene respectively and one or more additional, polymerizable α-olefin monomer. It is noted that although a polymer is often referred to as being "made of" one or more specified monomers, "based on" a specified monomer or monomer type, "containing" a specified monomer content, or the like, in this context the term "monomer" is obviously understood to be referring to the polymerized remnant of the specified monomer and not to the unpolymerized species. In general, polymers herein are referred to has being based on "units" that are the polymerized form of a corresponding monomer.

A "propylene-based polymer" is a polymer that contains more than 50 mole percent polymerized propylene monomer (based on the total amount of polymerizable monomers) and, optionally, may contain at least one comonomer.

EXAMPLES

The following is one embodiment of the present disclosure, as depicted in the drawings. While this describes one embodiment of the present disclosure, it will be apparent to those skilled in the art that various changes and modifications can be made without departing from the spirit and scope of the disclosure.

FIG. 1 shows a perspective view of a dispenser 10 for dispensing flexible sheets. The dispenser 10 includes a pouch 11. The pouch 11 includes a front wall 12 joined to a rear wall 14. A top seal 16 and a bottom seal 18 join the front wall 12 to the rear wall 14.

The dispenser 10 also includes a first sidewall 20 and an opposing second sidewall 22. The first sidewall is joined to the front wall 12 and the rear wall 14 with a first side seal 24. The second sidewall 22 is joined to the front wall 12 and the rear wall 14 with a second side seal 26.

The front wall 12, the rear wall 14, and the first and second sidewalls 20, 22 are made from respective first flexible multilayer film and second flexible multilayer film that are heat sealed together. The structure and the composition of the two flexible multilayer films are the same. Each flexible multilayer film is a laminate structure composed of PET print layer/tie/LLDPE intermediate layer/ethylene-octene copolymer sealant layer.

In an embodiment, each flexible multilayer film has a thickness of 4.5 mil and is composed of MYLAR (0.5 mil)/ADCOTE 577-577B (1.5-2.0 pph)/DOWLEX 2056G (1.7 mil)/AFFINITY PL1880G (2.8 mil).

Figure 2:
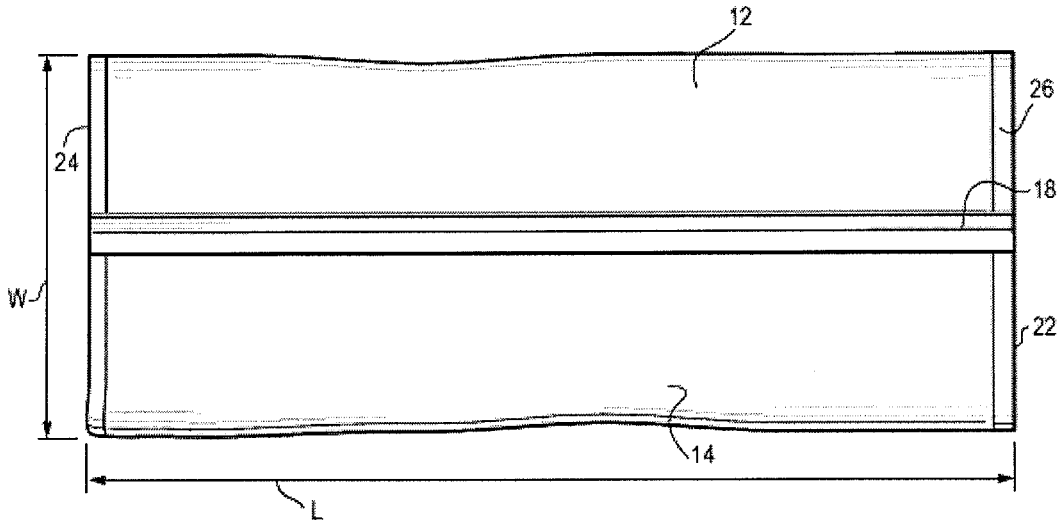
FIG. 2 is a bottom plan view of the dispenser of FIG. 1.

FIG. 2 is a bottom plan view of the dispenser 10. The bottom seal 18 is a fold seal that is a heat seal and extends the entire length L of the dispenser 10.

The dispenser 10 includes a flap 28 above the pouch 11. The flap 28 is joined to the pouch 11 along the top seal 16. A peripheral seal 29 extends from one end of the top seal 16 along the edge of the flap 28 and to the opposing end of the top seal 16. A hole 31 is present in the flap 28. The hole enables the dispenser 10 to be hung from a support structure such as a hanger.

Figure 3:
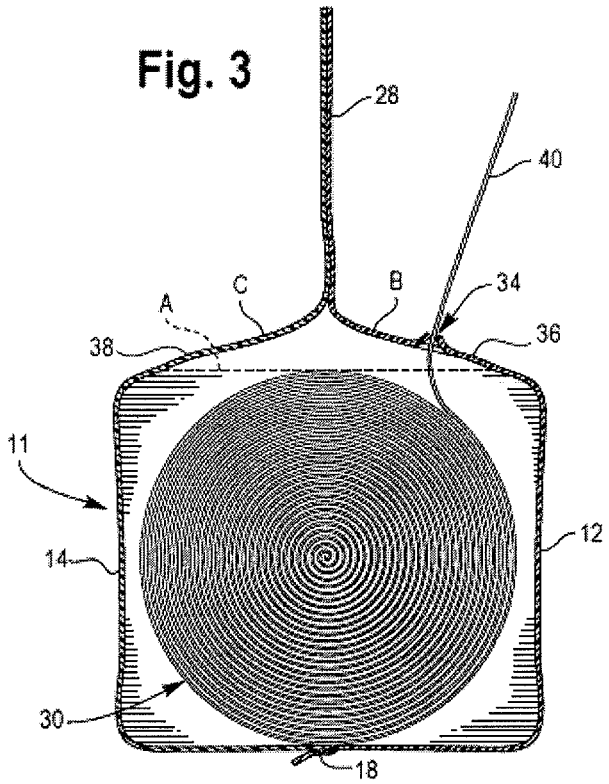
FIG. 3 is a sectional view of the dispenser taken along line 3-3 of FIG. 1.
Figure 4:
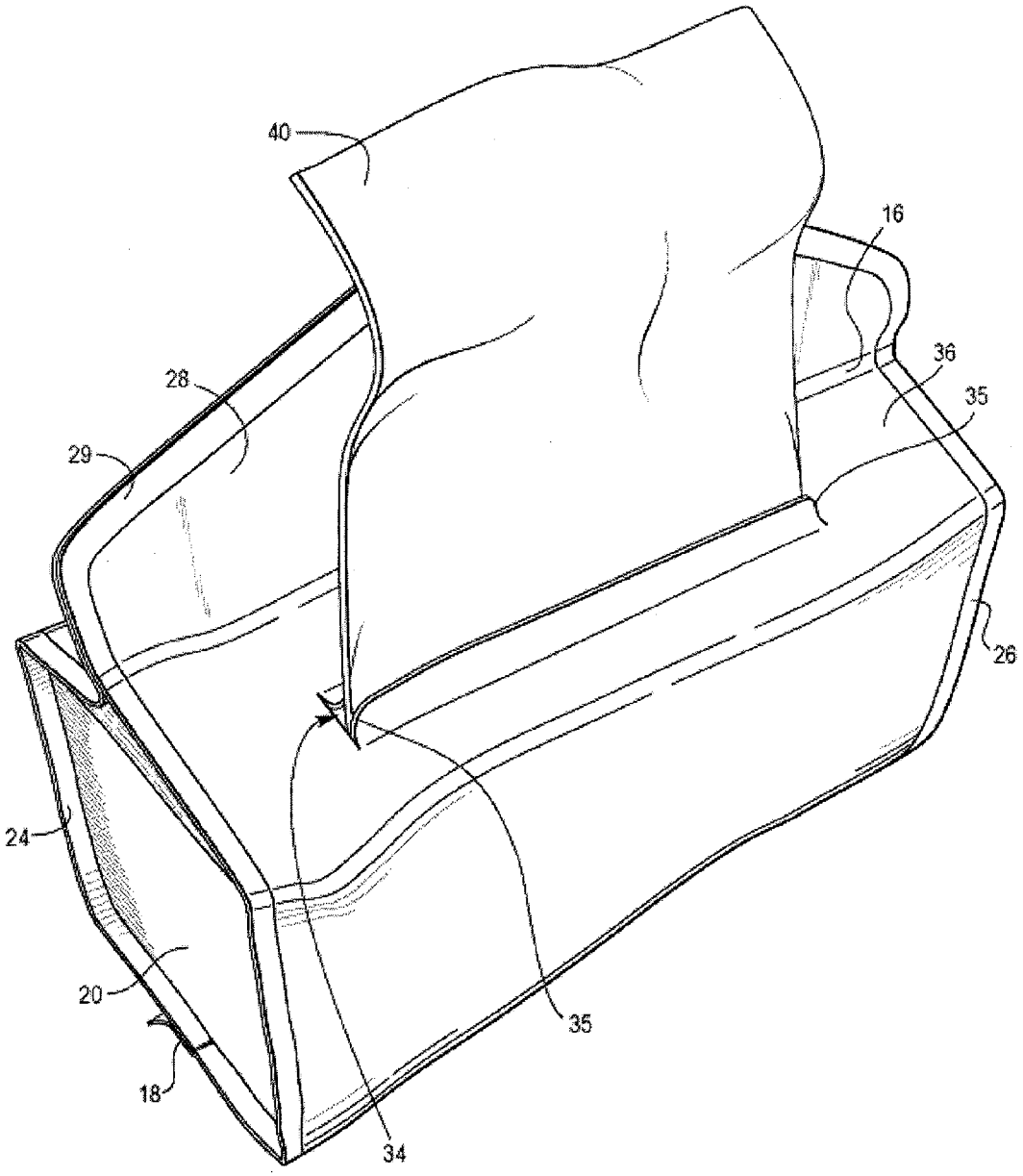
FIG. 4 is a perspective view of a flexible sheet being dispensed from the dispenser in accordance with an embodiment of the present disclosure.

A roll of continuous flexible sheets 30 (such as trash can liners) is present inside the pouch 11 as shown in FIG. 3. A perforation 32 is located along an upper portion of the front wall 12. A user actuates the perforation 32 to open the slot 34. The flexible sheets are then removed from the pouch through the slot 34. FIG. 4 shows an individual flexible sheet 40 in the slot 34 and ready for use.

The dispensing geometry of the slot 34 includes arcuate slot ends 35 to reduce, or prevent, tear of the front wall 12 at the slot.

The first side seal 24 and the second side seal 26 form respective gusset panels that shape the pouch 11. The front wall 12 includes a taper portion 36 and the rear wall 14 includes a taper portion 38 as shown in FIG. 3. The taper portions 36, 38 result from the shaping feature of the gusset panels. This taper feature provided by the taper portions 36, 38 produces pouch 11 with a tailored "form-fit" to the roll.

Another feature of the tailored form-fit produced by the gusset panels is a small headspace within the interior of the pouch 11. As shown in FIG. 3, the headspace is defined by (i) plane A (the plane that includes the uppermost surface of the roll 30), (ii) the interior surface of upper front wall B and (iii) the interior surface of the upper rear wall C. The headspace of present dispenser 10 is from 1% to 15% the total volume of the pouch 11 interior. In an embodiment, the headspace is from 1% to 10%, or 1% to 5% the total volume of the pouch 11 interior.

In an embodiment, the dispenser 10 weighs from 10 g to 30 g (without the continuous roll 30). In a further embodiment, the pouch 11 (without the roll) weighs 20 g.

In an embodiment each of top seal 16, bottom seal 18, first side seal 24, second side seal 26, and peripheral seal 29 have a seal strength from 20 N/25.4 mm to 60 N/25.4 mm.

It is specifically intended that the present disclosure not be limited to the embodiments and illustrations contained herein, but include modified forms of those embodiments including portions of the embodiments and combinations of elements of different embodiments as come within the scope of the following claims.

The invention claimed is:

1. A dispenser for dispensing flexible sheets comprising:

A. a pouch composed of at least one flexible multilayer film, the pouch comprising
   (i) a front wall joined to a rear wall along a top seal and a bottom seal that is a fold seal, the front wall and the rear wall each having a respective upper taper portion;
   (ii) a first sidewall and an opposing second sidewall, each sidewall joined to the front wall and the rear wall with a first side perimeter seal and a second side perimeter seal, respectively, the perimeter seals forming respective first sidewall gusset panel and second sidewall gusset panel;
   (iii) a flap above the pouch and joined to the pouch along the top seal;
   (iv) the pouch having a bottom surface comprising a lower portion of the front wall, a lower portion of the rear wall, and the bottom fold seal, wherein the bottom fold seal is substantially flat so that the bottom surface maintains the dispenser in an upright position;

B. a roll of continuous flexible sheets in an interior of the pouch; and

C. a slot extending along only the upper taper portion of the front wall through which the flexible sheets are removed from the pouch.

2. The dispenser of claim 1 wherein the top seal has a seal strength from 20 N/25.4 mm to 60 N/25.4 mm as measured in accordance with ASTM F 88.

3. The dispenser of claim 1 wherein the first side seal and the second side seal each have a seal strength from 20 N/25.4 mm to 60 N/25.4 mm as measured in accordance with ASTM F 88.

4. The dispenser of claim 1 wherein the fold seal has a seal strength from 20 N/25.4 mm to 60 N/25.4 mm as measured in accordance with ASTM F 88.

5. The dispenser of claim 1 wherein the flexible multilayer film has a tear strength measured in the cross direction from 500 g to 700 g as measured in accordance with ASTM D 624.

6. The dispenser of claim 1 wherein the flexible multilayer film has a tear strength measured in the machine direction from 200 g to 700 g as measured in accordance with ASTM D 624.

7. The dispenser of claim 1 wherein the roll is a continuous roll of trash can liners.

8. The dispenser of claim 1 wherein the flap comprises a hole.

9. The dispenser of claim 1 wherein the flap comprises a peripheral seal.

10. The dispenser of claim 1 wherein the flexible multilayer film comprises a print layer selected from the group consisting of biaxially oriented polypropylene, oriented polypropylene, polyethylene terephthalate, oriented polyethylene terephthalate, bi-axially oriented polyethylene terephthalate, and combinations thereof.

11. The dispenser of claim 1 wherein the flexible multilayer film comprises a seal layer comprising an ethylene-based polymer.

12. The dispenser of claim 1 wherein the dispenser comprises a headspace that is from 1% to 15% the volume of the pouch.

13. The dispenser of claim 1 wherein the dispenser comprises from 90 wt % to 100 wt % ethylene-based polymer.

14. The dispenser of claim 1 wherein the slot comprises arcuate slot ends to reduce tear of the front wall at the slot.

15. The dispenser of claim 1, wherein the flap comprises a peripheral seal extending from one end of the top seal, along the periphery of the flap, to a second end of the top seal.

* * * * *